US008846596B2

(12) United States Patent
Dykstra et al.

(10) Patent No.: US 8,846,596 B2
(45) Date of Patent: Sep. 30, 2014

(54) LIQUID CLEANING COMPOSITIONS

(75) Inventors: Robert Richard Dykstra, West Chester, OH (US); Mario Elmen Tremblay, West Chester, OH (US); Xiaoru Jenny Wang, Mason, OH (US); James Lee Danziger, Mason, OH (US); Daniel Dale Ditullio, Jr., Hamilton, OH (US); Consuelo Kong, Cincinnati, OH (US); Ismael Cotte-Rodriguez, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 76 days.

(21) Appl. No.: 13/397,736

(22) Filed: Feb. 16, 2012

(65) Prior Publication Data

US 2012/0208739 A1 Aug. 16, 2012

Related U.S. Application Data

(60) Provisional application No. 61/443,582, filed on Feb. 16, 2011.

(51) Int. Cl.

| | |
|---|---|
| ***C11D 1/12*** | (2006.01) |
| ***C11D 1/72*** | (2006.01) |
| ***C11D 3/20*** | (2006.01) |
| ***C11D 3/395*** | (2006.01) |
| ***C11D 3/39*** | (2006.01) |
| ***C11D 3/33*** | (2006.01) |
| ***C11D 3/34*** | (2006.01) |

(52) U.S. Cl.

CPC ..... *C11D 3/3932* (2013.01); *C11D 3/2058* (2013.01); *C11D 3/33* (2013.01); *C11D 3/3418* (2013.01)

USPC ..... 510/311; 510/336; 510/337; 510/338; 510/340; 510/351; 510/352; 510/356; 510/357; 510/370; 510/371; 510/376; 502/200; 502/324; 502/325

(58) Field of Classification Search

CPC ..... C11D 1/14; C11D 1/22; C11D 1/29; C11D 3/2082; C11D 3/30; C11D 3/33; C11D 3/34; C11D 3/3917; C11D 3/392

USPC ..... 510/311, 336, 337, 338, 340, 351, 352, 510/356, 357, 370, 371, 376; 502/200, 324, 502/325

See application file for complete search history.

(56) References Cited

U.S. PATENT DOCUMENTS

| | | | | |
|---|---|---|---|---|
| 6,218,351 | B1 * | 4/2001 | Busch et al. | 510/311 |
| 6,306,812 | B1 | 10/2001 | Perkins et al. | |
| 2002/0137654 | A1 | 9/2002 | Hage et al. | |
| 2002/0198126 | A1 * | 12/2002 | Irvin et al. | 510/305 |
| 2002/0198128 | A1 | 12/2002 | Perkins et al. | |
| 2006/0234893 | A1 * | 10/2006 | Busch et al. | 510/376 |
| 2010/0022431 | A1 * | 1/2010 | Lant et al. | 510/392 |
| 2011/0099725 | A1 | 5/2011 | Dykstra et al. | |
| 2012/0058927 | A1 | 3/2012 | Borchers et al. | |

FOREIGN PATENT DOCUMENTS

| | | | |
|---|---|---|---|
| WO | WO 98/39406 | A1 | 3/1998 |
| WO | WO98/39098 | * | 9/1998 |
| WO | WO 98/39098 | A1 | 9/1998 |
| WO | WO98/39406 | * | 9/1998 |
| WO | WO2004/000985 | * | 12/2003 |
| WO | WO 2004/000985 | A1 | 12/2003 |

OTHER PUBLICATIONS

International Search Report, 10 pages (Feb. 2012).

* cited by examiner

*Primary Examiner* — Gregory R Delcotto

(74) *Attorney, Agent, or Firm* — Gregory S. Darley-Emerson; Steven W. Miller

(57) ABSTRACT

Liquid cleaning compositions are described herein that include a metal bleach catalyst which is a complex of a transition-metal and a macrocyclic ligand, the ligand having a calculated Octanol/Water Partition Coefficient value of from about −1.50 to about −0.10, a formulation enabling fraction comprising at least one formulation enabling ingredient, the formulation enabling fraction having a Hydrophilic Index of from about 4.0 to about 10.0, and a formulation deactivating fraction comprising at least one formulation deactivating ingredient that has a calculated Octanol/Water Partition Coefficient value of from about −3.5 to about −0.10.

13 Claims, No Drawings

LIQUID CLEANING COMPOSITIONS

CROSS-REFERENCE TO RELATED APPLICATIONS

This application claims priority under 35 U.S.C. 119(e) to U.S. Provisional Application Ser. No. 61/443,582, filed Feb. 16, 2011.

FIELD OF INVENTION

The present application relates to liquid cleaning compositions that are useful for oxidizable stain removal on surfaces such as fabric, dishes, countertops, dentures and the like. The liquid cleaning compositions include a metal bleach catalyst which is a complex of a transition-metal and a macrocyclic ligand, the ligand of the metal bleach catalyst having a calculated Octanol/Water Partition Coefficient value of from about −1.50 to about −0.10.

BACKGROUND OF INVENTION

Metal bleach catalysts are useful in liquid cleaning compositions utilized for bleaching oxidizable substrates, including stains in solution and on surfaces such as fabric, dishes, countertops, dentures and the like. However, metal bleach catalysts contained in liquid cleaning compositions may lose catalytic activity over time due to interactions with other ingredients of the composition. Traditional solutions to minimize interactions between metal bleach catalysts and other formulation ingredients include encapsulation of the metal bleach catalyst and/or other formulation ingredients to create an impermeable or semi-impermeable shell. Encapsulation is expensive, and can still result in a reduction in metal bleach catalyst activity due to catalyst encapsulation leakage and diffusion of formulation ingredients into the encapsulate. Such leakage can occur at any point during the lifetime of the encapsulated metal bleach catalyst, including during in-product storage. Further, efforts to reduce leakage and/or diffusion can lead to insufficient or untimely metal bleach catalyst release. Accordingly, liquid cleaning compositions containing non-encapsulated metal bleach catalysts and non-encapsulated formulation ingredients that can still maintain the catalytic activity of the metal bleach catalyst over time are of continued interest.

SUMMARY OF INVENTION

According to one embodiment, the present disclosure provides for a liquid cleaning composition that includes a metal bleach catalyst which is a complex of a transition-metal and a macrocyclic ligand, the transition-metal bleach catalyst having a calculated Octanol/Water Partition Coefficient value of from about −1.50 to about −0.10, a formulation enabling fraction comprising at least one formulation enabling ingredient, the formulation enabling fraction having a Hydrophilic Index of from about 4.0 to about 10.0, and a formulation deactivating fraction comprising at least one formulation deactivating ingredient that has a calculated Octanol/Water Partition Coefficient value of from about −3.5 to about −0.10.

In another embodiment, the present disclosure provides for a liquid cleaning composition that includes 5,12-diethyl-1,5,8,12-tetraaza-bicyclo[6.6.2]hexadecane manganese(II) chloride, a formulation enabling fraction comprising at least one formulation enabling ingredient, the formulation enabling fraction having a Hydrophilic Index of from about 4.0 to about 10.0, and a formulation deactivating fraction comprising at least one formulation deactivating ingredient that has a calculated Octanol/Water Partition Coefficient value of from about −3.5 to about −0.10, wherein the 5,12-diethyl-1,5,8,12-tetraaza-bicyclo[6.6.2]hexadecane manganese(II) chloride has an aged activity that is greater than about 70% of an original activity after the composition is stored for two weeks at 40° C.

DETAILED DESCRIPTION OF THE INVENTION

Definitions

As used herein, the term "liquid cleaning composition" includes compositions and formulations designed for cleaning and/or treating fabric, dishes, countertops, dentures, hard surfaces, soft surfaces and the like. The term liquid cleaning composition encompasses the term "fabric care composition" defined below.

As used herein the term "fabric care composition" includes compositions and formulations designed for treating textiles and fabrics, such as, but not limited to, laundry cleaning compositions and detergents, laundry soap products, fabric softening compositions, fabric enhancing compositions, fabric freshening compositions, laundry prewash, laundry pretreat, laundry additives, spray products, and the like and may have a form selected from liquid (including heavy duty liquid ("HDL") detergents), gels, pastes, laundry detergent cleaning agents, laundry soak or spray treatments, pre-treatments, fabric treatment compositions, dry cleaning agent or composition, laundry rinse additive, wash additive, post-rinse fabric treatment, ironing aid, unit dose formulation, delayed delivery formulation, and the like. Such compositions may be used as a pre-laundering treatment, a post-laundering treatment, or may be added during the rinse or wash cycle of the laundering operation.

As used herein, the term "comprising" means various components conjointly employed in the preparation of the composition or methods of the present disclosure. Accordingly, the terms "consisting essentially of" and "consisting of" are embodied in the term "comprising".

As used herein, the articles including "the", "a" and "an" when used in a claim or in the specification, are understood to mean one or more of what is claimed or described.

As used herein, the terms "include", "includes" and "including" are meant to be non-limiting.

As used herein, the term "plurality" means more than one.

As used herein, the terms "fabric", "textile", and "cloth" are used non-specifically and may refer to any type of flexible material consisting of a network of natural or artificial fibers, including natural, artificial, and synthetic fibers, such as, but not limited to, cotton, linen, wool, polyester, nylon, silk, acrylic, and the like, including blends of various fabrics or fibers.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Liquid Cleaning Compositions:

The present disclosure provides for metal bleach catalyst containing liquid cleaning compositions (e.g., laundry detergents and additives) which provide improved catalytic activity over time. The challenge of formulating and maximizing the benefits of one or more metal bleach catalyst in a cleaning composition is that other formulation ingredients that are also incorporated into the composition to provide additional bleaching and/or non-bleaching benefits can reduce or inhibit the activity of the metal bleach catalysts. In other words, such ingredients can cause metal bleach catalyst deactivation in the liquid cleaning compositions. Such formulation ingredients are referred to as formulation deactivating ingredients, which combine to form a formulation deactivating fraction. The formulation deactivating fraction may include, but is not limited to, those materials that are capable of interacting with the transition metal of the metal bleach catalyst. Such interaction may occur during use of the liquid cleaning compositions or during in-product storage of the compositions. For example, the activity of the metal bleach catalyst may be reduced when the catalyst containing liquid cleaning composition is used for the purpose of dye transfer inhibition or the decolorization of unwanted dyes, especially dyes in solution, including fugitive dyes from fabrics or other substrates.

However, it has been surprisingly found that the deactivation of the metal bleach catalyst can be mitigated, or that is to say that the activity of the metal bleach catalyst can be maintained, in the presence of the formulation deactivating fraction through the utilization of a formulation enabling fraction. The formulation enabling fraction comprises one or more formulation enabling ingredient such as, for example, a surfactant or surfactant system that enables the activity of the metal bleach catalyst. In some embodiments of the liquid cleaning compositions detailed herein, the formulation enabling fraction includes particular surfactants or surfactant systems that favor the partitioning of the metal bleach catalyst to a more hydrophobic domain of the formulation enabling fraction (e.g., a micelle, vesicle or other surfactant structure). In those same embodiments, the formulation deactivating fraction may be selected to favor the partitioning of the formulation deactivating fraction to the more aqueous bulk phase of the liquid cleaning compositions, thus reducing the potentially unwanted interactions between the metal bleach catalyst and the formulation deactivating fraction. The decrease in interaction between the metal bleach catalyst and the formulation deactivating fraction is believed to maintain and/or improve the activity of the metal bleach catalyst.

Another challenge of formulating metal bleach catalysts in liquid cleaning compositions includes minimizing the degradation or loss of sensitive formulation ingredients such as perfume raw materials, dyes, etc. The reduction of such sensitive formulation ingredients can be exacerbated by the presence of metal bleach catalysts which catalyze unwanted side reactions. The surprising combination of a less hydrophobic formulation deactivating fraction, less hydrophobic sensitive formulation ingredients and a more hydrophobic metal bleach catalyst in a more hydrophobic formulation enabling fraction serves to maximize the metal bleach catalyst activity of the liquid cleaning compositions over time, while minimizing the unwanted oxidation of sensitive formulation components.

For embodiments of the liquid cleaning compositions described herein, the metal bleach catalyst present in the composition has an aged activity that is greater than about 70%, greater than about 75%, greater than about 80%, greater than about 85%, greater than about 90% or greater than about 95% of an original activity after the composition is stored for two weeks at 40° C. The original and aged activities of the metal bleach catalyst present in the liquid cleaning compositions described herein are measured by the Metal Bleach Catalyst Activity Protocol detailed herein.

Metal Bleach Catalyst:

Metal bleach catalysts useful in the liquid cleaning compositions described herein can consist of a pre-formed metal catalyst such as described in US 2009/0054293 A1, which were designed to provide a superior benefit to safety profile for the bleaching of stains during and/or after the wash. The ligands associated with such catalysts can serve to control or enhance the properties of the metal bleach catalyst by altering a variety of metal bleach catalyst properties, including but not limited to stain or fabric selectivity, deposition, reactivity, and so forth. The design of such metal bleach catalysts can enable improved benefit to risk ratio, wherein said risk may include negatives associated with uncontrolled bleaching chemistry, such as fabric dye fading or staining found with free transition metal contamination.

Generally speaking, the metal bleach catalysts systems, also known as complexes of metals and organic substances, are of the general formula: $[M_aL_kX_n]Y_m$, in which M represents the metal, L represents the ligand, and X represents a coordinating species. Y represents the counterion.

Suitable metals may be transition metals such as manganese, iron and copper. Suitable ligands of the metal bleach catalyst systems include a macropolycyclic rigid ligand of the formula:

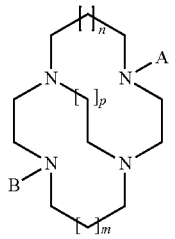

wherein n and m are integers individually selected from 1 and 2; p is an integer from 1 to 6; and A and B are independently selected from a group consisting of linear or branched, substituted or unsubstituted $C_1$-$C_{20}$ alkyl, alkylaryl, alkenyl or alkynyl. In certain useful ligands, m=n=p=1, and A and B are independently selected from the group consisting of methyl, ethyl, propyl, isopropyl, butyl, isobutyl, sec-butyl, tert-butyl, $C_5$-$C_{20}$ alkyl, and benzyl, optionally substituted with moieties selected from the group consisting of COOM, wherein M is selected from H and a charge balancing metal ion, CN and mixtures thereof. In other useful ligands, A and B are independently selected from methyl, ethyl and propyl. In other useful ligands, A and B are ethyl.

Particular transition-metal bleach catalysts of macrocyclic rigid ligands which are suitable for use in the cleaning compositions and methods of bleaching described herein may include known compounds that conform with the general description above, as well as any novel compounds expressly designed for cleaning compositions (fabric care or otherwise). Specific non-limiting examples of appropriate metal bleach catalysts may include one or more of the following:

Dichloro-5,12-dimethyl-1,5,8,12-tetraazabicyclo[6.6.2] hexadecane Manganese(II);

Dichloro-5,12-diethyl-1,5,8,12-tetraazabicyclo[6.6.2]hexadecane Manganese(II);

Diaquo-5,12-dimethyl-1,5,8,12-tetraazabicyclo[6.6.2]hexadecane Manganese(II) Hexafluorophosphate;

Diaquo-5,12-diethyl-1,5,8,12-tetraazabicyclo[6.6.2]hexadecane Manganese(II) Hexafluorophosphate;

Aquo-hydroxy-5,12-dimethyl-1,5,8,12-tetraazabicyclo [6.6.2]hexadecane Manganese(III) Hexafluorophosphate;

Diaquo-5,12-dimethyl-1,5,8,12-tetraazabicyclo[6.6.2]hexadecane Manganese(II) Tetrafluoroborate;

Dichloro-5,12-dimethyl-1,5,8,12 tetraazabicyclo[6.6.2] hexadecane Manganese(III) Hexafluorophosphate;

Dichloro-5,12-diethyl-1,5,8,12-tetraazabicyclo[6.6.2]hexadecane Manganese(III) Hexafluorophosphate;

Dichloro-5,12-di-n-butyl-1,5,8,12-tetraaza bicyclo[6.6.2] hexadecane Manganese(II);

Dichloro-5,12-dibenzyl-1,5,8,12-tetraazabicyclo[6.6.2] hexadecane Manganese(II);

Dichloro-5-n-butyl-12-methyl-1,5,8,12-tetraaza-bicyclo [6.6.2]hexadecane Manganese(II);

Dichloro-5-n-octyl-12-methyl-1,5,8,12-tetraaza-bicyclo [6.6.2]hexadecane Manganese(II); and Dichloro-5-n-butyl-12-methyl-1,5,8,12-tetraaza-bicyclo [6.6.2]hexadecane Manganese(II).

One particularly interesting metal bleach catalyst for use in the liquid cleaning compositions detailed herein is 5,12-diethyl-1,5,8,12-tetraaza-bicyclo[6.6.2]hexadecane manganese(II) chloride.

The ligands of the metal bleach catalyst employed in the liquid cleaning compositions detailed herein may be characterized by their Octanol/Water Partitioning Coefficient (P), otherwise known as log P, and when calculated, known as "C log P." The Octanol/Water Partitioning Coefficient of a ligand is the ratio between its equilibrium concentrations in octanol and in water. Since the partitioning coefficients of the ligands have high values, they are more conveniently given in the form of their logarithm to the base 10, log P.

The log P values of many materials (e.g., perfumes) have been reported; for example, the Pomona92 database, available from Daylight Chemical Information Systems, Inc. of Irvine, Calif., contains many such values, along with citations to the original literature. However, log P values are most conveniently calculated by the "C LOG P" program, also available from Daylight CIS. This program also lists experimental log P values when they are available in the Pomona92 database. The calculated log P (i.e., C log P) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990). The fragment approach is based on the chemical structure of each molecule (e.g., a particular ligand in this case), and takes into account the numbers and types of atoms, the atom connectivity, and chemical bonding. The C log P values (the most reliable and widely used estimates for the octanol/water partitioning coefficient) are preferably utilized instead of experimental log P values for the selection of the ligands of the metal bleach catalysts that are employed in the compositions described herein. The CogP values for the ligands of the metal bleach catalysts were determined using the commercially available version CS Log P-3.0 [from ChemSilicol].

The ligands of the metal bleach catalysts may have a C log P value in the range of from about −1.50 to about −0.10, from about −1.10 to about −0.30, from about −0.90 to about −0.40 or from about −0.75 to about −0.55. For example, the C Log P value for the ligand of 5,12-dimethyl-1,5,8,12-tetraaza-bicyclo[6.6.2]hexadecane manganese(II) chloride is calculated at −1.02 and the C Log P value for the ligand of 5,12-diethyl-1,5,8,12-tetraaza-bicyclo[6.6.2]hexadecane manganese(II) chloride is calculated at −0.64.

It is understood that the metal bleach catalyst of the present invention can undergo ligands exchange, including, but not limited to, an exchange of the chloride ligand(s) for water ligand(s), or any ligand capable of interacting with any oxidation state of the transition metal. Typical oxidation states of the metal include, for example, for manganese, the Mn(II), Mn(III), Mn(IV) and Mn(V) oxidation states, or mixtures thereof as described in WO-A-98/39098 and WO-A-98/39406.

The metal bleach catalyst may be present in the liquid cleaning compositions described herein in an amount ranging from about 0.00001% to about 10%, or from about 0.0001 to about 6%, or from about 0.0003 to about 3%; or from about 0.001 to about 1%; or from about 0.006 to about 0.3%; or from about 0.02 to about 0.1%.

Formulation Enabling Fraction

Embodiments of the compositions may include a formulation enabling fraction which comprises at least one formulation enabling ingredient. Embodiments of the compositions may comprise, by weight, from about 5% to about 90% of a formulation enabling fraction, from about 5% to about 70% of a formulation enabling fraction, or from about 5% to about 40% of a formulation enabling fraction. The formulation enabling ingredient(s) that make up the formulation enabling fraction are surfactants, and may be anionic surfactants, nonionic surfactants, cationic surfactants, zwitterionic surfactants, ampholytic surfactants, and mixtures thereof.

The formulation enabling fraction may have a "Hydrophilic Index" or "HI" of from about 4.0 to about 10.0, from about 5.0 to about 9.9, from about 5.5 to about 8.7, from about 5.8 to about 7.6, or from 6.0 to 7.0. The Hydrophilic Index for a surfactant molecule is referred to herein as $HI_S$. The Hydrophilic Index for any given surfactant system can be calculated by summing the weight averaged $HI_S$ for each surfactant in the surfactant system. The Hydrophilic Index for a system of mixed surfactants ("$HI_C$") can be calculated as follows:

$$HI_C = \Sigma_y(\text{weight \% of surfactant } y \text{ in the surfactant system}) \times (HI_S \text{ for surfactant } y). \quad (1)$$

$HI_S$ is calculated for each of the individual surfactants in the mixture as follows:

$$HI_S = 20 \times (\text{the molecular weight of the head group})/(\text{the molecular weight the surfactant}). \quad (2)$$

In the case of ionic surfactants, the $HI_S$ values in equation (2) are calculated for the surfactant ions and the weight percents in equation (1) are for the corresponding surfactant ions.

Table I below illustrates how the Hydrophilic Index is calculated for various surfactants that are commonly used in laundry detergents. In the following table "Cn" is the average chain length of the surfactant molecule, and "phobe" represents the molecular weight of the hydrophobic portion of the surfactant molecule. Likewise, "phil" is the molecular weight of the hydrophilic portion of the surfactant molecule. "Total" is the sum of the phobe and the phil, that is, the average molecular weight of the surfactant molecule. "WF phil" is the weight fraction of the philic portion, that is, the molecular weight of the philic portion divided by the total molecular weight.

The "$HI_S$" is the WF phil multiplied by 20. For ionic surfactants the $HI_S$ value is calculated for the surfactant ion only, i.e., the counterion is ignored.

TABLE I

| Surfactants | #EO | Cn | Phobe | Phil | Total | WF phil | $HI_S$ |
|---|---|---|---|---|---|---|---|
| Nonionics | | | | | | | |
| AE 23-3 | 3 | 12.5 | 176 | 149 | 325 | 0.459 | 9.17 |
| AE 23-5 | 5 | 12.5 | 176 | 237 | 413 | 0.574 | 11.48 |
| AE 23-6.5 | 6.5 | 12.5 | 176 | 303 | 479 | 0.633 | 12.65 |
| AE 23-9 | 9 | 12.5 | 176 | 413 | 589 | 0.701 | 14.02 |
| AE 24-7 | 7 | 13 | 183 | 325 | 508 | 0.640 | 12.80 |
| CMG | | 13 | 183 | 238 | 421 | 0.565 | 11.31 |
| Anionics (anions) | | | | | | | |
| C25AS | 0 | 13.5 | 190 | 96 | 286 | 0.336 | 6.71 |
| C25AE3.0S | 3 | 13.5 | 190 | 228 | 418 | 0.546 | 10.91 |
| C25AE1.8S | 1.8 | 13.5 | 190 | 175.2 | 365.2 | 0.480 | 9.59 |
| C11.8 LAS | 0 | 11.8 | 242.5 | 80 | 322.2 | 0.248 | 4.97 |
| C45E1.0S | 1 | 14.5 | 204 | 140 | 344 | 0.407 | 8.14 |
| C45E2.25S | 2.25 | 14.5 | 204 | 195 | 399 | 0.489 | 9.77 |
| C45E3.0S | 3 | 14.5 | 204 | 228 | 432 | 0.528 | 10.56 |
| Cationics (cations) | | | | | | | |
| C10 APA | | 10 | 141 | 101 | 242 | 0.417 | 8.35 |
| C8-10 APA | | 9 | 127 | 101 | 228 | 0.443 | 8.86 |

The above list of common laundry detergent surfactants is only for the explanation of how to calculate HI index values, and is not limiting to the particular surfactants that may be employed in the liquid cleaning compositions detailed herein.

Suitable anionic surfactants for employment in the compositions described herein may include any of the conventional anionic surfactant types typically used in liquid detergent products. These include the alkyl benzene sulfonic acids and their salts as well as alkoxylated or non-alkoxylated alkyl sulfate materials. Non-limiting examples of anionic surfactants are the alkali metal salts of $C_{10-16}$ alkyl benzene sulfonic acids, more specifically, $C_{11-14}$ alkyl benzene sulfonic acids. In some embodiments, the alkyl group is linear and such linear alkyl benzene sulfonates are known as "LAS". Alkyl benzene sulfonates, and particularly LAS, are well known in the art. Such surfactants and their preparation are described for example in U.S. Pat. Nos. 2,220,099 and 2,477,383. More particular non-limiting examples of alkylbenzene sulfonates suitable for employment as formulation enabling ingredients include sodium and potassium linear straight chain alkylbenzene sulfonates in which the average number of carbon atoms in the alkyl group is from about 11 to 14. One specific non-limiting example of a formulation enabling ingredient is sodium $C_{11}$-$C_{14}$, (e.g., $C_{12}$) LAS.

Another exemplary type of suitable anionic surfactant is ethoxylated alkyl sulfate surfactants, known as "AES." Such materials, also known as alkyl ether sulfates or alkyl polyethoxylate sulfates, are those which correspond to the formula: $R'—O—(C_2H_4O)_n—SO_3M$ wherein R' is a $C_8$-$C_{20}$ alkyl group, n is from about 1 to 20, and M is a salt-forming cation. In some embodiments, R' is $C_{10}$-$C_{18}$ alkyl, n is from about 1 to 15, and M is sodium, potassium, ammonium, alkylammonium, or alkanolammonium. In more specific embodiments, R' is a $C_{12}$-$C_{16}$, n is from about 1 to 6 and M is sodium.

The alkyl ether sulfates will generally be used in the form of mixtures comprising varying R' chain lengths and varying degrees of ethoxylation. Frequently such mixtures will inevitably also contain some non-ethoxylated alkyl sulfate materials, i.e., surfactants of the above ethoxylated alkyl sulfate formula wherein n=0. Non-ethoxylated alkyl sulfates may also be added separately to the compositions or employed in any anionic surfactant component which may be present. Specific examples of non-alkoxylated, e.g., non-ethoxylated, alkyl ether sulfate surfactants are those produced by the sulfation of higher $C_8$-$C_{20}$ fatty alcohols. Examples of primary alkyl sulfate surfactants may have the general formula: $ROSO_3$-$M^+$ wherein R is typically a linear $C_8$-$C_{20}$ hydrocarbyl group, which may be straight chain or branched chain, and M is a water-solubilizing cation. In more specific examples, R is a $C_{10}$-$C_{15}$ alkyl, and M is alkali metal, more specifically R is $C_{12}$-$C_{14}$ and M is sodium.

Another exemplary type of suitable anionic surfactant is mid-branched primary alkyl sulfate surfactants having an average carbon chain length of from about 14 to about 17 ("MBAS surfactants"). MBAS surfactants with a carbon chain length of about 16 to 17 are known as HSAS surfactants. Employment of HSAS surfactants typically results in an increase in the hydrophobicity of the formulation enabling fraction. Without being bound by theory, it has been surprising found that this increased hydrophobicity of the formulation enabling fraction appears to lead to a decrease in bleaching lag time and/or an increase in metal bleach catalyst activity when used as described in the present invention.

Suitable nonionic (NI) surfactants for employment in the compositions described herein may comprise any of the conventional nonionic surfactant types typically employed in liquid detergent products. Such non-ionic surfactants include alkoxylated fatty alcohols and amine oxide surfactants. Non-limiting examples of suitable nonionic surfactants for use herein are alcohol alkoxylate nonionic surfactants. Alcohol alkoxylates (AEs) are materials which correspond to the general formula: $R^1O(C_mH_{2m}O)_nH$ wherein $R^1$ is a $C_8$-$C_{16}$ alkyl group, m is from 2 to 4, and n ranges from about 2 to 12. For example, one example of a polyoxyethylene alkyl ether (alcohol alkoxylate) is $R_{12}H_{25}O(CH_2CH_2O)_7H$, also known as Laureth-7 or Surfonic® L24-7 from Huntsman Corporation.

In some examples, the $R^1$ is an alkyl group, which may be primary or secondary, that comprises from about 9 to 15 carbon atoms, or from about 10 to 14 carbon atoms. In one embodiment, the alkoxylated fatty alcohols will also be ethoxylated materials that contain from about 2 to 12 ethylene oxide moieties per molecule, or from about 3 to 10 ethylene oxide moieties per molecule. More specific examples of alkoxylated fatty alcohol nonionic surfactants have been marketed under the trade names Neodol® and Dobanol by the Shell Chemical Company.

Another suitable type of nonionic surfactant useful herein comprises the amine oxide surfactants. Amine oxides are materials which are often referred to in the art as "semi-polar" nonionics. Amine oxides have the formula: $R(EO)_x(PO)_y(BO)_zN(O)(CH_2R')_2H_2O$. In this formula, R is a relatively long-chain hydrocarbyl moiety which can be saturated or unsaturated, linear or branched, and can contain from 8 to 20, or from 10 to 16 carbon atoms, and in some embodiments can be $C_{12}$-$C_{16}$ primary alkyl. R' is a short-chain moiety that may be selected from hydrogen, methyl and $—CH_2OH$. When x+y+z is different from 0, EO is ethyleneoxy, PO is propyleneoxy and BO is butyleneoxy. One specific example of amine oxide surfactants is $C_{12-14}$ alkyldimethyl amine oxide.

Suitable cationic surfactants for employment in the compositions described herein may comprise any of the conventional nonionic surfactant types typically employed in liquid detergent products. Cationic surfactants are well known in the art and non-limiting examples of these include quaternary ammonium surfactants, which can have up to 26 carbon atoms. Additional examples include a) alkoxylate quaternary ammonium (AQA) surfactants as discussed in U.S. Pat. No. 6,136,769; b) dimethyl hydroxyethyl quaternary ammonium as discussed in U.S. Pat. No. 6,004,922; c) polyamine cationic surfactants as discussed in WO 98/35002, WO 98/35003, WO 98/35004, WO 98/35005, and WO 98/35006; d) cationic ester surfactants as discussed in U.S. Pat. Nos. 4,228,042, 4,239,660 4,260,529 and U.S. Pat. No. 6,022,844; and e) amino surfactants as discussed in U.S. Pat. No. 6,221,825 and WO 00/47708, specifically amido propyldimethyl amine (APA).

Suitable zwitterioinic surfactants for employment in the compositions described herein may comprise any of the conventional nonionic surfactant types typically employed in liquid detergent products. Non-limiting examples of zwitterionic surfactants include derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 for additional examples of zwitterionic surfactants.

Suitable ampholytic surfactants for employment in the compositions described herein may comprise any of the conventional nonionic surfactant types typically employed in liquid detergent products. Non-limiting examples of ampholytic surfactants include aliphatic derivatives of secondary or tertiary amines, or aliphatic derivatives of heterocyclic secondary and tertiary amines in which the aliphatic radical can be straight- or branched-chain. One of the aliphatic substituents comprises at least about 8 carbon atoms, typically from about 8 to about 18 carbon atoms, and at least one comprises an anionic water-solubilizing group, e.g. carboxy, sulfonate, sulfate. See U.S. Pat. No. 3,929,678 additional for examples of ampholytic surfactants.

In some embodiments of the liquid cleaning compositions described herein, the formulation enabling fraction may include a mixture of low $HI_S$ and high $HI_S$ surfactants, wherein low $HI_S$ surfactants are defined by having an $HI_S$ value of about less than or equal to 7.0, and a high $HI_S$ surfactants are defined by having an $HI_S$ value of about greater than or equal to 8.0.

In another embodiment, the formulation enabling fraction may include a mixture of low $HI_S$ and high $HI_S$ surfactants, wherein low $HI_S$ surfactants are defined by having an $HI_S$ value of from about 4.0 to 6.0, and a high $HI_S$ surfactants are defined by having an $HI_S$ value of from about 10.0 to 14.0.

In the embodiments that include a formulation enabling fraction comprising the formulation enabling ingredients of low $HI_S$ and high $HI_S$ surfactants, the ratio of low $HI_S$ and high $HI_S$ surfactants may be from about 90:10 to about 30:70, or from about 80:20 to about 40:60, or from about 70:30 to about 55:45. Accordingly, a formulation enabling fraction comprising such ratios of low $HI_S$ to high $HI_S$ may serve to increase the compatibility of the metal bleach catalyst with any sensitive formulation ingredients with compatible HI indexes.

Formulation enabling fractions of low $HI_S$ and high $HI_S$ surfactants in such ratios have a Hydrophilic Index of from about 4.0 to about 10.0, from about 5.0 to about 9.9, from about 5.5 to about 8.7, from about 5.8 to about 7.6, or from 6.0 to 7.0. Accordingly, a formulation enabling fraction comprising such LAS:AES ratios may serve to increase the compatibility of the metal bleach catalyst with any sensitive formulation ingredients with compatible HI indexes.

In one embodiment the low $HI_S$ surfactants is selected from alkyl sulfate surfactants, preferably non-ethoxylated C11-15 primary and secondary alkyl sulfates; more preferably alkyl benzene sulfonates, and particularly LAS.

In another embodiment the high $HI_S$ surfactants is selected from alkoxylate surfactants, including anionic surfactants such as alkyl ethoxy sulfate (AES) surfactants and nonionic surfactants such as alcohol ethoxylate (AE) surfactants.

In some embodiments of the liquid cleaning compositions described herein, the formulation enabling fraction may include a mixture of LAS, AES, AE, and any combination thereof. However, it is understood that other embodiments may include different or additional formulation enabling ingredients. In the embodiments that include a formulation enabling fraction comprising the formulation enabling ingredients of LAS, AES, and/or AE, the ratio of LAS:AES and/or AE may be from about 90:10 to about 30:70, or from about 80:20 to about 40:60, or from about 70:30 to about 55:45. Formulation enabling fractions of LAS:AES and/or AE in such ratios have a Hydrophilic Index of from about 4.0 to about 10.0, from about 5.0 to about 9.9, from about 5.5 to about 8.7, from about 5.8 to about 7.6, or from 6.0 to 7.0. Accordingly, a formulation enabling fraction comprising such LAS:AES and/or AE ratios may serve to increase the compatibility of the metal bleach catalyst with any sensitive formulation ingredients with compatible HI indexes.

Formulation Deactivating Fraction

Embodiments of the compositions may include a formulation deactivating fraction which comprises at least one formulation deactivating ingredient. In one embodiment, the compositions comprise from about 0.05 to about 10 wt %, or from about 0.1 to about 5.0 wt %, or from about 0.5 to about 2.0 wt % of a formulation deactivating fraction.

Examples of such deactivation formulation ingredients include, but are not limited to, chelants (i.e., chelators, chelating agents, sequestrants) such as transition metal chelants that include but are not limited to catechol-based chelants, such as mono, bis, and/or tris complexes of 1,2-dihydroxy-3,5-benzenedisulfonate and/or polyamine carboxylate-based chelants, including but not limited to diethylene triamine pentaacetic acid (DTPA) and/or amine-based chelants such as ethylenediamine or diethylenetriamine. Without mitigating factors, the presence of the formulation deactivating fraction can significantly reduce the activity of the metal bleach catalyst in the liquid cleaning composition, as well as increase the lag time of the bleach.

In some embodiments, the formulation activation ingredient may be a catechol moiety selected from the following formula:

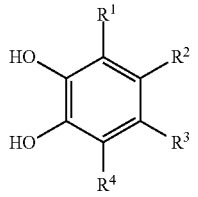

or the deprotonated or partially deprotonated form thereof, wherein $R^1$, $R^2$, $R^3$ and $R^4$ may be independently selected from H, $R^5$, —$SO_3$, COOH, $COOR^6$ and $OR^7$, wherein $R^5$—$R^7$ are independently selected from substituted and substituted, linear or branched C1-C12 alkyls, alkylenes, alkoxys, aryl, alkaryls, aralkyls, cycloalkyls and heterocyclic rings. In another embodiment, $R^2$ and $R^4$ are H and $R^1$ and $R^3$ are —$SO_3$ groups.

In embodiments of the liquid cleaning compositions detailed herein, the deactivating formulation ingredient may have a C Log P value of from about −3.50 to about −0.10, from about −2.80 to about −0.50, or from about −2.30 to about −1.50. In addition, embodiments of the liquid cleaning compositions detailed herein may include a ratio of deactivating formulation ingredient to metal bleach catalyst from about 1000:1 to about 1:2, from about 250:1 to about 2:1, from about 100:1 to about 5:1, or from about 50:1 to about 10:1.

Sensitive Formulation Ingredients

In another aspect of the liquid cleaning compositions detailed herein, the sensitive formulation ingredients have a C Log P value that may be less than or equal to about 4.0, less than or equal to about 3.0, or less than or equal to about 2.0. Sensitive formulation ingredients are selected from, but not limited to, the group consisting of perfume raw materials, especially those that have a relatively low C Log P value.

Non-limiting examples of suitable perfume raw materials having a molecular weight of less than about 200 and/or a boiling point of less than about 250° C. and/or a C log P of less than about 4 include, but are not limited to, benzaldehyde, benzyl acetate, laevo-carvone, geraniol, hydroxycitronellal, cis-jasmone, linalool, nerol, phenyl ethyl alcohol, alpha-terpineol, eugenol, methyl cinnamate, methyl-N-methyl anthranilate, vanillin, iso-bornyl acetate, carvacrol, alpha-citronellol, citronellol, anisic aldehyde, linalyl acetate, methyl anthranilate, flor acetate and dihydro myrcenol.

In one embodiment of the liquid cleaning compositions detailed herein, suitable perfume raw materials may have a molecular weight of less than about 200 and/or a boiling point of less than about 250° C. and/or a C log P of less than about 3, and may be selected from the group consisting of: benzaldehyde, benzyl acetate, laevo-carvone, geraniol, hydroxycitronellal, cis-jasmone, linalool, nerol, phenyl ethyl alcohol, alpha-terpineol, dihydro myrcenol, citronellol, anisic aldehyde, linalyl acetate, methyl anthranilate, flor acetate and mixtures thereof.

Without wishing to be bound by theory, sensitive formulation ingredients with low C Log P values are more prone to reside in the bulk aqueous phase of the liquid cleaning formulations along with the formulation deactivating fraction such that there is reduced concentration of sensitive formulation ingredients in the presence of the more hydrophobic metal bleach catalyst (which is present in the more hydrophobic formulation enabling fraction). The surprising combination of a less hydrophobic formulation deactivating fraction, less hydrophobic sensitive formulation ingredients and more hydrophobic metal bleach catalyst in a more hydrophobic formulation enabling fraction serves to minimize unwanted oxidation of sensitive formulation components.

Adjunct Materials

According to specific embodiments, the compositions may further comprise one or more additives or adjuncts. While not essential for the purposes of the present disclosure, the non-limiting list of additives or adjuncts illustrated hereinafter are suitable for use in various embodiments of the fabric care compositions and may be desirably incorporated in certain embodiments of the disclosure, for example to assist or enhance performance or to modify the aesthetics of the composition as is the case with perfumes, colorants, dyes or the like. In the present disclosure, the terms "additive" and adjunct" may be used interchangeably. It is understood that such adjuncts are in addition to the components that were previously listed for any particular embodiment. The total amount of such adjuncts may range from about 0.1% to about 50%, or even from about 1% to about 30%, by weight of the liquid cleaning composition.

Suitable additives or adjuncts include, but are not limited to, bleach activators, surfactants, builders, chelating agents, dye transfer inhibiting agents, dispersants, enzymes, enzyme stabilizers, catalytic metal complexes, polymeric dispersing agents, clay and soil removal/anti-redeposition agents, brighteners, suds suppressors, dyes, perfumes, perfume delivery systems, structure elasticizing agents, fabric softeners, carriers, hydrotropes, solvents, processing aids, and pigments, as described herein.

The precise nature of these additional components, and levels of incorporation thereof, will depend on the physical form of the fabric care composition and the nature of the operation for which it is to be used. Suitable additive and adjunct materials include, but are not limited to, polymers, for example cationic polymers, surfactants, builders, chelating agents, dye transfer inhibiting agents, dispersants, enzymes, and enzyme stabilizers, catalytic materials, bleach activators, polymeric dispersing agents, clay soil removal/anti-redeposition agents, brighteners, suds suppressors, dyes, additional perfume and perfume delivery systems, structure elasticizing agents, fabric softeners, carriers, hydrotropes, processing aids and/or pigments. In addition to the disclosure below, suitable examples of such other adjuncts and levels of use are found in U.S. Pat. Nos. 5,576,282; 6,306,812; and 6,326,348.

As stated, the adjunct ingredients are not essential to the fabric care compositions. Thus, certain embodiments of the compositions do not contain one or more of the following adjuncts materials: bleach activators, surfactants, builders, chelating agents, dye transfer inhibiting agents, dispersants, enzymes, and enzyme stabilizers, catalytic metal complexes, polymeric dispersing agents, clay and soil removal/anti-redeposition agents, brighteners, suds suppressors, dyes, additional perfumes and perfume delivery systems, structure elasticizing agents, fabric softeners, carriers, hydrotropes, processing aids and/or pigments. However, when one or more adjuncts are present, such one or more adjuncts may be present as detailed below:

Builders—The compositions of the present disclosure can comprise one or more detergent builders or builder systems. When present, the compositions will typically comprise at least about 1% builder, or from about 5% or 10% to about 80%, 50%, or even 30% by weight, of said builder. Builders include, but are not limited to, the alkali metal, ammonium and alkanolammonium salts of polyphosphates, alkali metal silicates, alkaline earth and alkali metal carbonates, aluminosilicate builders polycarboxylate compounds, ether hydroxypolycarboxylates, copolymers of maleic anhydride with ethylene or vinyl methyl ether, 1,3,5-trihydroxybenzene-2,4,6-trisulphonic acid, and carboxymethyl-oxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Chelating Agents—The compositions herein may also optionally contain one or more copper, iron and/or manganese chelating agents. If utilized, chelating agents will generally comprise from about 0.1% by weight of the compositions herein to about 15%, or even from about 3.0% to about 15% by weight of the compositions herein.

Dye Transfer Inhibiting Agents—The compositions of the present disclosure may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in the compositions herein, the dye transfer inhibiting agents are present at levels from about 0.0001%, from about 0.01%, from about 0.05% by weight of the cleaning compositions to about 10%, about 2%, or even about 1% by weight of the cleaning compositions.

Dispersants—The compositions of the present disclosure can also contain dispersants. Suitable water-soluble organic materials are the homo- or co-polymeric acids or their salts, in which the polycarboxylic acid may comprise at least two carboxyl radicals separated from each other by not more than two carbon atoms.

Enzymes—The compositions can comprise one or more detergent enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination is a cocktail of conventional applicable enzymes like protease, lipase, cutinase and/or cellulase in conjunction with amylase.

Enzyme Stabilizers—Enzymes for use in compositions, for example, detergents can be stabilized by various techniques. The enzymes employed herein can be stabilized by the presence of water-soluble sources of calcium and/or magnesium ions in the finished compositions that provide such ions to the enzymes.

Processes of Making Liquid Cleaning Compositions

The liquid cleaning compositions of the present disclosure can be formulated into any suitable form and prepared by any process chosen by the formulator, non-limiting examples of which are described in U.S. Pat. Nos. 5,879,584; 5,691,297; 5,574,005; 5,569,645; 5,565,422; 5,516,448; 5,489,392; and 5,486,303.

In one aspect, the liquid cleaning compositions disclosed herein may be prepared by combining the components thereof in any convenient order and by mixing, e.g., agitating, the resulting component combination to form a phase stable liquid cleaning composition. In one aspect, a liquid matrix is formed containing at least a major proportion, or even substantially all, of the liquid components and the emulsion, e.g., nonionic surfactant, the non-surface active liquid carriers and other optional liquid components, with the liquid components being thoroughly admixed by imparting shear agitation to this liquid combination. For example, rapid stirring with a mechanical stirrer may usefully be employed. While shear agitation is maintained, substantially all of any anionic surfactant and the solid ingredients can be added. Agitation of the mixture is continued, and if necessary, can be increased at this point to form a solution or a uniform dispersion of insoluble solid phase particulates within the liquid phase. After some or all of the solid-form materials have been added to this agitated mixture, particles of any enzyme material to be included, e.g., enzyme prills may be incorporated. As a variation of the composition preparation procedure described above, one or more of the solid components may be added to the agitated mixture as a solution or slurry of particles premixed with a minor portion of one or more of the liquid components. After addition of all of the composition components, agitation of the mixture is continued for a period of time sufficient to form compositions having the requisite viscosity and phase stability characteristics. Frequently this will involve agitation for a period of from about 30 to 60 minutes.

In another aspect of producing liquid cleaning compositions, the emulsion comprising the hydrophobic liquid and particulate material may first be combined with one or more liquid components to form a premix, and this premix may be added to a composition formulation containing a substantial portion, for example more than 50% by weight, more than 70% by weight, or even more than 90% by weight, of the balance of components of the liquid cleaning composition. For example, in the methodology described above, both the premix and the enzyme component may be added at a final stage of component additions.

Methods of Using Liquid Cleaning Compositions

The liquid laundry compositions disclosed in the present specification may be used to clean or treat an article (e.g., fabric, dishes, hard surfaces, countertops, dentures and the like). Typically at least a portion of the article is contacted with an embodiment of the aforementioned liquid cleaning composition, in neat form or diluted in a liquor, for example, a wash liquor and then the article may be optionally washed and/or rinsed. In one aspect, an article is optionally washed and/or rinsed, contacted with an embodiment of the aforementioned liquid cleaning composition and then optionally washed and/or rinsed. For purposes of the present disclosure, washing includes, but is not limited to, scrubbing, and mechanical agitation. In methods of cleaning fabric, the fabric may comprise most any fabric capable of being laundered or treated.

In certain embodiments, the liquid cleaning compositions disclosed in the present application can be used to form aqueous washing solutions for use in the laundering of fabrics. Generally, an effective amount of such composition is added to water, preferably in a conventional fabric laundering automatic washing machine, to form an aqueous laundering solution. The aqueous laundering solution is then contacted, preferably under agitation, with one or more fabrics to be laundered. The compositions according to the present disclosure may be used in various types of washing machines and processes, including, but not limited to, top loading washing machines, front loading washing machines, Miele type washing machines, commercial washing machines, industrial washing machines, and hand washing processes.

In one aspect, the liquid cleaning compositions may be employed as a laundry additive, a pre-treatment composition and/or a post-treatment composition. For example, in certain embodiments, the liquid cleaning composition may be in the form of a spray which is sprayed on a surface of the fabric. In other embodiments, the liquid cleaning composition may be in the form of a soak or rinse composition, such as a pre- or post-laundering soak or rinse composition. In these embodiments, the fabric to be treated may be soaked or rinsed in the liquid cleaning composition to impart the enhanced cleaning characteristics.

While various specific embodiments have been described in detail herein, the present disclosure is intended to cover various different combinations of the disclosed embodiments and is not limited to those specific embodiments described herein. The various embodiments of the present disclosure may be better understood when read in conjunction with the following representative examples. The following representative examples are included for purposes of illustration and not limitation.

EXAMPLES

Exemplary liquid cleaning compositions as described herein are listed below in Tables 1-13. The listed ingredients are assumed 100% active, and the amount of each ingredient is measured in weight percent of the total liquid cleaning composition.

TABLE 1

Bleach & Laundry Additive Detergent Formulations

| Ingredient | A | B | C | D | E | F |
|---|---|---|---|---|---|---|
| LAS[2] | — | — | — | 12.0 | 12.0 | 12.0 |
| Zwitterionic ethoxylated quaternized sulfated hexamethylene diamine[3] | — | — | — | 2.0 | | |
| Chelant[18] | 1.0 | 2.0 | 3.0 | 2.0 | 2.0 | 2.0 |
| MBC-1 | 0.1 | 0.1 | 0.1 | 0.1 | 0.1 | 0.1 |
| pH | 5.0 | 5.0 | 5.0 | 5.0 | 4.0 | 10.0 |
| Perfume | 0.25 | — | — | 0.25 | — | — |
| Water other optional agents/ components* | to 100% balance | to 100% balance | to 100% balance | to 100% balance | to 100% balance | to 100% balance |
| HI | — | — | — | 4.97 | 4.97 | 4.97 |
| MBC activity after 2 weeks at 40 C. | 20% | 15% | 10% | >95% | >95% | >95% |

TABLE 2

Bleach & Laundry Additive Detergent Formulations

| Ingredient | A | B | C | D | E | F |
|---|---|---|---|---|---|---|
| AES[1] | — | — | — | — | — | — |
| LAS[2] | 16.0 | 16.0 | 16.0 | 4.0 | 8.0 | 16.0 |
| MBC-1 | 0.1 | 0.1 | 0.1 | 0.1 | 0.1 | 0.1 |
| pH | 4.0 | 6.0 | 7.0 | 5.0 | 5.0 | 5.0 |
| Perfume | 0.25 | 0.25 | 0.25 | — | — | — |
| Dye | 0.0009 + 0.0007 | — | — | — | — | — |
| water | to 100% balance | to 100% balance | to 100% balance | to 100% balance | to 100% balance | to 100% balance |
| HI value of the surfactant system | 4.97 | 4.97 | 4.97 | 4.97 | 4.97 | 4.97 |
| MBC activity after 2 weeks at 40° C. | >98% | >98% | >98% | >95% | >95% | >95% |

TABLE 3

Bleach & Laundry Additive Detergent Formulations

| Ingredient | A | B | C | D | E | F |
|---|---|---|---|---|---|---|
| LAS[2] | 22.0 | 22.0 | 12.0 | 12.0 | 12.0 | 12.0 |
| Zwitterionic ethoxylated quatemized sulfated hexamethylene diamine[3] | — | 1.0 | 2.0 | 5.0 | — | — |
| Chelant[19] | — | — | — | — | 1.0 | 3.0 |
| MBC-1 | 0.1 | 0.1 | 0.1 | 0.1 | 0.1 | 0.1 |
| pH | 5.0 | 5.0 | 5.0 | 5.0 | 5.0 | 5.0 |
| Perfume | 0.3 | 0.3 | — | — | — | — |
| water | to 100% balance | to 100% balance | to 100% balance | to 100% balance | to 100% balance | to 100% balance |
| HI | 4.97 | 4.97 | 4.97 | 4.97 | 4.97 | 4.97 |
| MBC activity after 2 weeks at 40 C. | >95% | >95% | >95% | >95% | >95% | >95% |

TABLE 4

Bleach & Laundry Additive Detergent Formulations

| Ingredient | A | B | C | D | E | F |
|---|---|---|---|---|---|---|
| AES[1] | 8.0 | 8.0 | 8.0 | 8.0 | 8.0 | 8.0 |
| LAS[2] | 16.0 | 16.0 | 16.0 | — | — | — |
| Zwitterionic ethoxylated quaternized sulfated hexamethylene diamine[3] | 2.0 | 2.0 | 2.0 | 2.0 | — | 2.0 |
| Chelant[19] | 2.5 | 2.5 | 2.5 | 2.5 | 2.5 | 2.5 |
| Chelant[18] | 2.5 | 2.5 | 2.5 | 2.5 | 2.5 | 2.5 |
| 1,2 propandiol | 3 | 3 | 3 | 3 | 3 | 3 |
| MBC-1 | 0.075 | 0.075 | 0.075 | 0.075 | 0.075 | 0.075 |
| pH | 2.5 | 8.5 | 10 | 5.0 | 7.0 | 7.0 |
| water, other optional agents/ components* | to 100% balance | to 100% balance | to 100% balance | to 100% balance | to 100% balance | to 100% balance |
| HI | 6.78 | 6.78 | 6.78 | 10.40 | 10.40 | 10.40 |
| MBC activity after 2 weeks at 40 C. | 25% | 49% | 5% | 15% | 53% | 20% |

TABLE 5

Bleach & Laundry Additive Detergent Formulations

| Ingredient | A | B | C | D | E | F |
|---|---|---|---|---|---|---|
| AES[1] | 8.0 | — | 8.0 | 8.0 | 8.0 | 8.0 |
| LAS[2] | 16.0 | 16.0 | 16.0 | 16.0 | 16.0 | 16.0 |
| Zwitterionic ethoxylated quaternized sulfated hexamethylene diamine[3] | 2.0 | 2.0 | 2.0 | 2.0 | 2.0 | 2.0 |
| Chelant[19] | 2.5 | 2.5 | — | 2.5 | 2.5 | — |
| Chelant[18] | 2.5 | 2.5 | 2.5 | — | 2.5 | — |
| 1,2-propandiol | — | 6.0 | 10.0 | 10.0 | 10.0 | 10.0 |
| MBC-1 | 0.075 | 0.075 | 0.075 | 0.075 | 0.075 | 0.075 |
| pH | 5.0 | 5.0 | 5.0 | 5.0 | 5.0 | 5.0 |
| Perfume | 0.3 | — | — | — | — | — |
| Water, other optional agents/ components* | to 100% balance | to 100% balance | to 100% balance | to 100% balance | to 100% balance | to 100% balance |
| HI | 6.78 | 4.97 | 6.78 | 6.78 | 6.78 | 6.78 |
| MBC activity after 2 weeks at 40 C. | 95% | 95% | 95% | 95% | 95% | 93% |

TABLE 6

Bleach & Laundry Additive Detergent Formulations

| Ingredient | A | B | C | D | E | F |
|---|---|---|---|---|---|---|
| AES[1] | 2.0 | 4.0 | — | 4.0 | 1.0 | 12.0 |
| LAS[2] | 10.0 | 10.0 | 38.0 | 12.0 | 4.0 | 27.0 |
| Zwitterionic ethoxylated quaternized sulfated hexamethylene diamine[3] | 1.0 | — | 2.0 | 1.0 | — | 2.0 |
| Chelant[19] | 0.5 | 0.5 | 2.5 | — | — | 2.5 |
| Chelant[18] | 0.5 | 2.5 | — | — | — | 2.5 |
| 1,2-propandiol | 10 | 10.0 | 20 | 10 | — | 20 |
| MBC-1 | 0.11 | 0.05 | 0.11 | 0.05 | 0.05 | 0.028 |
| pH | 5.0 | 5.0 | 5.0 | 5.0 | 5.0 | 5.0 |

TABLE 6-continued

| Bleach & Laundry Additive Detergent Formulations | | | | | | |
|---|---|---|---|---|---|---|
| Ingredient | A | B | C | D | E | F |
| Brightener 49 | 0.2 | — | — | 0.2 | — | 0.2 |
| water, other optional agents/ components* | to 100% balance | to 100% balance | to 100% balance | to 100% balance | to 100% balance | to 100% balance |
| HI | 5.87 | 6.52 | 4.97 | 6.33 | 6.05 | 6.64 |
| MBC activity after 2 weeks at 40 C. | 95% | 95% | 95% | 95% | 95% | 93% |

TABLE 7

| Bleach & Laundry Additive Detergent Formulations | | | | | | |
|---|---|---|---|---|---|---|
| Ingredient | A | B | C | D | E | F |
| AES[1] | 8.0 | 8.0 | 8.0 | 8.0 | 8.0 | 8.0 |
| LAS[2] | 16.0 | 16.0 | 16.0 | 16.0 | — | — |
| Zwitterionic ethoxylated quaternized sulfated hexamethylene diamine[3] | 2.0 | 2.0 | 2.0 | 2.0 | 2.0 | 2.0 |
| Chelant[19] | 2.5 | 2.5 | 2.5 | 2.5 | 2.5 | 2.5 |
| Chelant[18] | 2.5 | 2.5 | — | — | — | — |
| 1,2-propandiol | 3.0 | 3.0 | 3.0 | 3.0 | 3.0 | 3.0 |
| MBC-1 | 0.11 | 0.11 | 0.11 | 0.11 | 0.11 | 0.11 |
| pH | 5.0 | 5.0 | 5.0 | 5.0 | 5.0 | 5.0 |
| Perfume | 0.2 | 0.2 | 0.2 | 0.2 | 0.2 | 0.2 |
| Dye | 0.58 | 0.58 | 0.58 | 0.58 | 0.58 | 0.58 |
| water, other optional agents/ components* | to 100% balance | to 100% balance | to 100% balance | to 100% balance | to 100% balance | to 100% balance |
| HI | 6.78 | 6.78 | 6.78 | 6.78 | 10.40 | 10.40 |

TABLE 7-continued

| Bleach & Laundry Additive Detergent Formulations | | | | | | |
|---|---|---|---|---|---|---|
| Ingredient | A | B | C | D | E | F |
| MBC activity after 2 weeks at 40 C. | 95% | 96% | 98% | 95% | 58% | 60% |

TABLE 8

| Bleach & Laundry Additive Detergent Formulations | | | | | | |
|---|---|---|---|---|---|---|
| Ingredient | A | B | C | D | E | F |
| AES[1] | 0.8 | 0.8 | 8.0 | 8.0 | 8.0 | 8.0 |
| LAS[2] | 1.6 | 1.6 | 16.0 | 16.0 | — | — |
| Zwitterionic ethoxylated quaternized sulfated hexamethylene diamine[3] | 0.2 | 0.2 | 2.0 | 2.0 | 2.0 | 2.0 |
| Chelant[19] | 0.25 | 0.25 | 2.5 | 2.5 | 2.5 | 2.5 |
| Chelant[18] | 0.25 | 0.25 | — | — | — | — |
| 1,2-propandiol | 0.3 | — | 3.0 | 3.0 | 3.0 | 3.0 |
| MBC-1 | 0.011 | 0.011 | 0.11 | 0.11 | 0.11 | 0.11 |
| pH | 5.0 | 5.0 | 10.0 | 10.0 | 10.0 | 10.0 |
| Perfume | — | — | 0.2 | 0.2 | 0.2 | 0.2 |
| Dye | — | — | 0.58 | 0.58 | 0.58 | 0.58 |
| water, other optional agents/ components* | to 100% balance | to 100% balance | to 100% balance | to 100% balance | to 100% balance | to 100% balance |
| HI | 6.78 | 6.78 | 6.78 | 6.78 | 10.40 | 10.40 |
| MBC activity after 2 weeks at 40 C. | 95% | 98% | 96% | 95% | 53% | 51% |

TABLE 9

| Bleach & Laundry Additive Detergent Formulations | | | | | | |
|---|---|---|---|---|---|---|
| Ingredient | A | B | C | D | E | F |
| AES[1] | 10.0 | 10.0 | 8.0 | 8.0 | 8.0 | 8.0 |
| LAS[2] | 25.0 | 25.0 | 16.0 | 16.0 | 16.0 | 16.0 |
| Zwitterionic ethoxylated quaternized sulfated hexamethylene diamine[3] | 2.0 | 2.0 | 2.0 | 2.0 | 2.0 | 2.0 |
| Chelant[19] | 2.5 | 2.5 | 2.5 | 2.5 | 2.5 | 2.5 |
| Chelant[18] | 2.5 | 2.5 | 2.5 | 2.5 | 2.5 | 2.5 |
| 1,2-propandiol | 20 | 20 | — | — | 10 | 10 |
| MBC-1 | 0.108 | 0.108 | 0.108 | 0.108 | 0.108 | 0.108 |
| pH | 5.0 | 5.0 | 5.0 | 5.0 | 5.0 | 5.0 |
| Perfume | 0.3 | — | 0.3 | — | 0.3 | — |
| Dye | 0.0009 + 0.0007 | — | 0.0009 + 0.0007 | — | 0.0009 + 0.0007 | — |
| water, other optional agents/components | to 100% balance | to 100% balance | to 100% balance | to 100% balance | to 100% balance | to 100% balance |
| HI | 6.52 | 6.52 | 6.78 | 6.78 | 6.78 | 6.78 |
| MBC activity after 2 weeks at 40 C. | >95% | >95% | >95% | >95% | >95% | >95% |

TABLE 10

Bleach & Laundry Additive Detergent Formulations

| Ingredient | A | B | C | D | E | F |
|---|---|---|---|---|---|---|
| AES[1] | 2.0 | 4.0 | — | 12.0 | 5.0 | 10.0 |
| LAS[2] | 10.0 | 10.0 | 23.6 | 22.0 | 12.0 | 26.8 |
| Zwitterionic ethoxylated quaternized sulfated hexamethylene diamine[3] | 1.0 | — | — | — | — | 2.0 |
| HSAS[14] | — | — | — | 6.5 | 3.8 | — |
| Nonionic Surfactant (NI)[15b] | — | — | — | — | 3.6 | — |
| Fatty acid[16] | — | — | — | — | 4.4 | — |
| Amine Oxide[17a] | — | — | — | 2.1 | — | — |
| Chelant[19] | 0.51 | 0.77 | 1.5 | — | — | 2.5 |
| 4,5-Dihydroxy-1,3-benzene-disulfonic acid disodium salt | 1.82 | — | — | — | — | 2.5 |
| 1,2-propandiol | 10 | 10 | — | — | 5 | 20.0 |
| MBC-1 | 0.03 | — | — | — | — | — |
| MBC-2 | — | 0.05 | — | — | 0.11 | 0.05 |
| MBC-3 | — | — | 0.19 | — | — | — |
| MBC-4 | — | — | — | 0.04 | — | — |
| Perfume | 0.1 | 0.5 | 0.7 | 0.2 | — | — |
| Brightener 49 | 0.21 | — | — | 0.15 | — | 0.20 |
| water, other optional agents/ components* | to 100% balance | to 100% balance | to 100% balance | to 100% balance | to 100% balance | to 100% balance |
| pH adjusted with NaOH to: | 5.1 | 8.3 | 7.5 | 6.6 | 4.3 | 5.7 |

TABLE 11

Bleach & Laundry Additive Detergent Formulations

| Ingredients | A | B | C | D | E | F |
|---|---|---|---|---|---|---|
| AES[1] | 3.4 | 10.3 | — | 24.0 | 7.0 | 9.0 |
| LAS[2] | 8.8 | 14.6 | 18.5 | 15.0 | 15.0 | 24.7 |
| Zwitterionic ethoxylated quaternized sulfated hexamethylene diamine[3] | 0.4 | — | — | — | — | — |
| HSAS[14] | 3.2 | 6.5 | — | 3.7 | — | — |
| Nonionic Surfactant (NI)[15b] | 2.3 | — | 4.1 | — | — | — |
| Fatty acid[16] | 3.0 | — | — | 6.3 | — | — |
| Amine Oxide[17b] | — | — | — | 1.1 | 2.2 | — |
| Chelant[19] | 0.51 | — | — | — | — | 2.6 |
| Chelant[18] | — | 1.3 | 3.9 | — | — | 1.4 |
| 1,2-propandiol | 10 | — | 20 | 10 | — | 20 |
| MBC-1 | 0.03 | — | — | 0.03 | — | — |
| MBC-2 | — | 0.05 | 0.08 | — | 0.05 | 0.13 |
| MBC-3 | — | — | — | 0.02 | — | — |
| Perfume | 0.1 | — | 0.7 | 0.2 | — | 0.15 |
| Brightener 49 | 0.21 | — | — | 0.15 | — | 0.18 |
| water, other optional agents/ components* | to 100% balance | to 100% balance | to 100% balance | to 100% balance | to 100% balance | to 100% balance |

TABLE 12

Bleach & Laundry Additive Detergent Formulations

| Ingredients | A | B | C | D | E | F |
|---|---|---|---|---|---|---|
| AES[1] | 4.0 | 6.0 | — | 16.0 | 12.0 | 10.0 |
| LAS[2] | 8.0 | 10.0 | 20.6 | 15.0 | — | 26.1 |
| Bio-HSAS[14] | — | 1.9 | 3.2 | — | — | — |
| Nonionic Surfactant (NI)[15b] | — | — | — | 6.3 | — | — |
| Fatty acid[16] | — | — | — | 4.0 | — | — |
| Amine Oxide[17b] | — | — | — | 1.4 | — | — |
| Chelant[19] | 0.51 | 0.77 | 1.5 | — | — | 2.6 |
| Chelant[18] | 1.82 | — | 3.3 | — | — | 1.4 |
| 1,2-propandiol | — | 10 | — | 20 | 5 | 16 |
| MBC-1 | 0.03 | — | — | — | — | — |
| MBC-2 | — | 0.05 | 0.02 | 0.03 | 0.05 | 0.13 |
| Perfume | — | 0.2 | 0.03 | 0.17 | — | 0.15 |
| Brightener | 0.21 | — | — | 0.15 | — | 0.18 |
| water, other optional agents/ components* | to 100% balance | to 100% balance | to 100% balance | to 100% balance | to 100% balance | to 100% balance |

TABLE 13

Bleach & Laundry Additive Detergent Formulations

| Ingredients | A | B | C | D | E | F |
|---|---|---|---|---|---|---|
| AES[1] | 11.3 | 6.0 | 15.4 | 16.0 | 12.0 | 10.0 |
| LAS[2] | 25.6 | 12.0 | 4.6 | — | — | 26.1 |
| MEA-HSAS[14] | — | — | — | 3.5 | — | — |
| Chelant[19] | 0.51 | — | 1.5 | — | — | 2.6 |
| Chelant[18] | 1.82 | — | — | — | — | 1.4 |
| 1,2-propandiol | — | 10 | — | — | — | 15 |
| MBC-1 | 0.51 | — | — | — | — | — |
| MBC-2 | — | 0.05 | 0.04 | 0.07 | 0.05 | 0.13 |
| Copolymer of dimethyl-terephthalate, 1,2-propylene glycol, methyl capped PEG | 2.0 | | | | | |
| Poly(ethylene-imine) ethoxylated, PEI600 E20 | | 1.8 | | | | |
| Acrylic acid/ maleic acid copolymer | | | 2.9 | | | |
| Acusol 880 (Hydro-phobically Modified Non-Ionic Polyol) | | | | 2.0 | 1.8 | 2.9 |
| Protease | — | — | — | — | 0.1 | 0.1 |
| Natalase | — | — | — | — | — | 0.02 |
| Perfume | — | 0.2 | 0.03 | 0.17 | — | 0.15 |
| Brightener | 0.21 | — | — | 0.15 | — | 0.18 |
| water, other optional agents/ components* | to 100% balance | to 100% balance | to 100% balance | to 100% balance | to 100% balance | to 100% balance |

TABLE 14

Bleach & Laundry Additive Detergent Formulations

| Ingredients | A | B | C | D | E | F |
|---|---|---|---|---|---|---|
| AES[1] | — | 5.2 | — | — | — | 9.3 |
| HLAS[2] | 15.0 | 8.9 | 20.0 | 11.6 | 20.0 | — |

TABLE 14-continued

| Bleach & Laundry Additive Detergent Formulations | | | | | | |
|---|---|---|---|---|---|---|
| Ingredients | A | B | C | D | E | F |
| Zwitterionic ethoxylated quaternized sulfated hexamethylene diamine[3] | 2.0 | — | — | — | — | — |
| HSAS[14c] | 2.5 | 4.6 | — | — | — | 11.6 |
| Alcohol Alkoxylate[15a] | — | 5.0 | — | — | — | — |
| Alcohol Alkoxylate[15b] | 15.0 | 10.2 | 18.8 | 12.5 | — | — |
| Alcohol Alkoxylate[15c] | 1.5 | — | — | — | — | — |
| Chelant[19] | 2.5 | — | — | 3.3 | 2.3 | 1.0 |
| Chelant[18] | 1.5 | 3.5 | 0.5 | — | 2.5 | 4.5 |
| 1,2-propandiol | 8.0 | 5.7 | — | 6.9 | — | — |
| MBC-2 | 0.015 | 0.049 | 0.005 | 0.033 | 0.11 | 0.010 |
| Acusol 880 | 6.0 | — | — | — | 4.6 | 2.6 |
| Perfume | 0.50 | — | 0.30 | 0.87 | 0.11 | 0.72 |
| Melamine-formaldehyde Perfume Microcapsule | — | — | — | 0.25 | — | — |
| Brightener | 0.31 | — | 0.26 | — | 0.29 | — |
| NaOH (92% total) | 1.4 | 1.6 | — | 1.9 | 1.0 | 2.2 |
| water, other optional agents/ components* | to 100% balance | to 100% balance | to 100% balance | to 100% balance | to 100% balance | to 100% balance |

Footnotes for the compositions of A-F in Tables 1-14:

[1]AES = $C_{10}$-$C_{18}$ alkyl ethoxy sulfate (AES) supplied by Shell Chemicals.

[2]LAS = $C_9$-$C_{15}$ linear alkyl benzene sulfonate supplied by Huntsman Corp

[13]Soil Anti-Redeposition Agent = Zwitterionic ethoxylated quaternized sulfated hexamethylene diamine available under the tradename LUTENSIT ® from BASF (Ludwigshafen, Germany) and such as those described in WO 01/05874

[14]HSAS = HC1617HSAS (mid-branched primary alkyl sulfate surfactants having an average carbon chain length of from about 16 to 17)

[15a]Nonionic Surfactant (NI) = Alcohol Ethoxylate (AE) = C24EO9

[15b]Nonionic Surfactant (NI) = Alcohol Ethoxylate (AE) = Surfonic L 24-7 (Laureth-7)

[15c]Nonionic Surfactant (NI) = Alcohol Ethoxylate (AE) = Surfonic L 24-3 (Laureth-3)

[16]Fatty acid = octadecanoic acid

[17a]Amine Oxide = DMDAO (dimethyldodecyl amine oxide)

[17b]Amine Oxide = CAPOA (cocoamidopropyldimethyl amine oxide)

[18]Chelant = 4,5-Dihydroxy-1,3-benzenedisulfonic acid disodium salt (Tiron)

[19]Chelant = Diethylene triamine pentaacetic acid (DTPA)

*Other optional agents/components include suds suppressors, structuring agents like NaSWT (Hydrogenated Castor Oil, Anionic Premix), Mica pearlescent aesthetic enhancer, Anticide/Antimicrobial Agent Key for the specific metal bleach catalysts employed in the formulations of Tables 1-14:

MBC-1: 5,12-dimethyl-1,5,8,12-tetraaza-bicyclo[6.6.2]hexadecane manganese (II) chloride MBC-2: 5,12-diethyl-1,5,8,12-tetraaza-bicyclo[6.6.2]hexadecane manganese (II) chloride MBC-3: 5-ethyl-12-methyl-1,5,8,12-tetraaza-bicyclo[6.6.2]hexadecane manganese (II) chloride MBC-4: 5,12-dipropyl-1,5,8,12-tetraaza-bicyclo[6.6.2]hexadecane manganese (II) chloride MBC-5: 5,12-dibenzyl-1,5,8,12-tetraaza-bicyclo[6.6.2]hexadecane manganese (II) chloride MBC-6: 5-n-octyl-12-methyl-1,5,8,12-tetraaza-bicyclo[6.6.2]hexadecane manganese (II) chloride MBC-7: Diaquo-5,12-diethyl-1,5,8,12-tetraazabicyclo[6.6.2]hexadecane manganese(II) hexafluorophosphate MBC-8: Aquo-hydroxy-5,12-dimethyl-1,5,8,12-tetraazabicyclo[6.6.2]hexadecane manganese(III) hexafluorophosphate MBC-9: Aquo-hydroxy-5,12-diethyl-1,5,8,12-tetraazabicyclo[6.6.2]hexadecane Manganese(III) Hexafluorophosphate MBC-10: Dichloro-5,12-diethyl-1,5,8,12 tetraazabicyclo[6.6.2]hexadecane Manganese (III) Hexafluorophosphate Metal Bleach Catalyst Activity Protocol:

The Konelab dye method is used to analyze the metal bleach catalyst activity of the embodiments of the liquid cleaning compositions. It is a UV-VIS method using Chicago Sky Blue dye as an indicator and hydrogen peroxide as a reagent. Within a UV-Visible spectrometer (Beckman Coulter DU® 800), an added amount of metal bleach catalyst containing composition reacts with hydrogen peroxide, and discolors the Chicago Sky Blue dye. A calibration linear curve is produced first to correlate the amount of metal bleach catalyst based on the amount of dye present in the matrix. The metal bleach catalyst activity is then measured with the correlation against the calibration curve based on the amount of dye present in the matrix. The solutions used are prepared as following:

Blank Matrix Solution:

Weigh 1.0023 g of free matrix metal bleach catalyst (MBC) into a 100 mL volumetric flask and dilute to volume with DI water. Stir to mix.

Metal Bleach Catalyst (MBC) Standard:

Weigh 0.0300 g of metal bleach catalyst into a 100 mL volumetric flask and dilute to volume in DI water. Stir to dissolve.

Dye Reagent:

Add 0.0065 g of Chicago Sky Blue dye into a 100 mL volumetric flask and dilute to volume with a pH 9.0 borate buffer. Stir to mix. This is a reagent to be added directly in the instrument.

$H_2O_2$ Reagent:

Add 0.33 mL of hydrogen peroxide to a 10 mL volumetric flask and dilute to volume with DI water. Stir to mix, and then added to instrument.

Samples:

To create sample, weigh 1 g of liquid cleaning composition into a 100 mL volumetric flask and dilute to volume with DI water. Mix samples for 15 minutes before use. After samples are added into instrument, dye reagent and $H_2O_2$ Reagent are added into the instrument and UV-Vis data was taken.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present disclosure. To the extent that any meaning or definition of a term in this document conflicts with any meaning or definition of the same term in a document incorporated by reference, the meaning or definition assigned to that term in this document shall govern.

While particular embodiments of the present disclosure have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid cleaning composition comprising:

a. a metal bleach catalyst which is a complex of a transition-metal and a macrocyclic ligand, the ligand of the metal bleach catalyst having a calculated Octanol/Water Partition Coefficient value of from about −1.50 to about −0.10;

b. from about 5% to about 40%, by weight, of a formulation enabling fraction comprising at least one formulation enabling ingredient, the formulation enabling fraction having a Hydrophilic Index of from about 4.0 to about 10.0; and c. from about 0.1% to about 5.0% by weight of a formulation deactivating fraction comprising at least one formulation deactivating ingredient that has a calculated Octanol/Water Partition Coefficient value of from about −3.5 to about −0.10; and d. water;

wherein the transition-metal of the metal bleach catalyst is manganese-based and the macrocyclic ligand of the transition-metal bleach catalyst has the following structure:

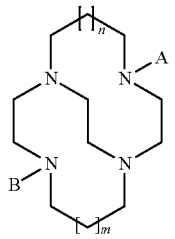

wherein n and m are integers individually selected from 1 and 2; and A and B are independently selected from a group consisting of hydrogen or methyl, ethyl, propyl, isopropyl, butyl, isobutyl, sec-butyl, tert-butyl, $C_5$-$C_{20}$ alkyl, and benzyl, optionally substituted with moieties selected from the group consisting of COOM, wherein M is selected from H and a charge balancing metal ion, CN and mixtures thereof;

wherein the at least one formulation enabling ingredient comprises an anionic surfactant selected from a group consisting of linear alkylbenzene sulfonate, alkyl ethoxysulfate, and mixtures thereof;

wherein the at least one formulation deactivating ingredient comprises a catechol moiety of the following formula:

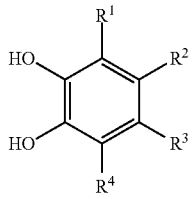

or the deprotonated or partially deprotonated version thereof, wherein $R^1$, $R^2$, $R^3$ and $R^4$ may be independently selected from H, $R^5$, —$SO_3$, COOH, $COOR^6$ and $OR^7$, wherein $R^5$-$R^7$ are independently selected from alkyl groups;

wherein the metal bleach catalyst has an aged activity that is greater than about 70% of an original activity after the composition is stored for two weeks at 40° C.;

and wherein the composition has a pH of from 4 to 7.

2. The composition of claim 1, wherein the metal bleach catalyst is 5,12-diethyl-1,5,8,12-tetraaza-bicyclo[6.6.2] hexadecane manganese (II) chloride.

3. The composition of claim 1, wherein the formulation enabling fraction comprises linear alkylbenzene sulfonate and alkyl ethoxysulfate, wherein the weight ratio of linear alkylbenzene sulfonate to alkyl ethoxysulfate in the composition is in a range of from about 90:10 to about 30:70.

4. The composition of claim 1, wherein the formulation enabling fraction comprises linear alkylbenzene sulfonate and alcohol ethoxylate, wherein the weight ratio of linear alkylbenzene sulfonate to alcohol ethoxylate in the composition is in a range of from about 90:10 to about 30:70.

5. The composition of claim 1, wherein the formulation enabling fraction comprises linear alkylbenzene sulfonate, alkyl ethoxysulfate, and alcohol ethoxylate, wherein the weight ratio of linear alkylbenzene sulfonate to the combination of alkyl ethoxysulfate and alcohol ethoxylate in the composition is in a range of from about 90:10 to about 30:70.

6. The composition of claim 1, wherein the formulation deactivating ingredient further comprises a member selected from a group consisting of transition metal chelants, polyamine carboxylate-based chelants, amine-based chelants and mixtures thereof.

7. The composition of claim 1, wherein the catechol moiety comprises 4,5-dihydroxy-1,3-benezenedisulfonic acid disodium salt.

8. The composition of claim 7, wherein the formulation deactivating fraction further comprises diethylene triamine pentaacetic acid.

9. The composition of claim 1, further comprising at least one sensitive formulation ingredient that has a C Log P value of less than or equal to 4.0.

10. A liquid cleaning composition comprising:

a. 5,12-diethyl-1,5,8,12-tetraaza-bicyclo[6.6.2]hexadecane manganese (II) chloride;

b. from about 5% to about 40%, by weight, of a formulation enabling fraction comprising at least one formulation enabling ingredient, the formulation enabling fraction having a Hydrophilic Index of from about 4.0 to about 10.0;

c. from about 0.1% to about 5.0% by weight of a formulation deactivating fraction comprising at least one formulation deactivating ingredient that has a calculated Octanol/Water Partition Coefficient value of from about −3.5 to about −0.10; and d. water;

wherein the 5,12-diethyl-1,5,8,12-tetraaza-bicyclo[6.6.2] hexadecane manganese (II) chloride has an aged activity that is greater than about 70% of an original activity after the composition is stored for two weeks at 40° C.;

wherein the formulation enabling fraction comprises:

i. linear alkylbenzene sulfonate; and ii. alkyl ethoxysulfate, alcohol ethoxylate, and mixtures thereof;

wherein the weight ratio of linear alkylbenzene sulfonate to alkyl ethoxysulfate and/or alcohol ethoxylate in the composition is in a range of from about 90:10 to about 30:70;

wherein the at least one formulation deactivating ingredient comprises a catechol moiety of the following formula:

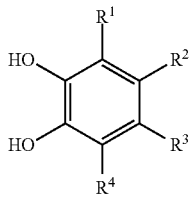

or the deprotonated or partially deprotonated version thereof, wherein $R^1$, $R^2$, $R^3$ and $R^4$ may be independently selected from H, $R^5$, —$SO_3$, COOH, $COOR^6$ and $OR^7$, wherein $R^5$-$R^7$ are independently selected from alkyl groups;

and wherein the composition has a pH of from 4 to 7.

11. The composition of claim 10, wherein the formulation deactivating fraction comprises 4,5-dihydroxy-1,3-benezenedisulfonic acid disodium salt and diethylene triamine pentaacetic acid.

12. The composition of claim 10, wherein the formulation deactivating fraction comprises 4,5-dihydroxy-1,3-benezenedisulfonic acid disodium salt.

13. The composition of claim 10, further comprising at least one sensitive formulation ingredient that has a C Log P value of less than or equal to 4.0.

* * * * *